US007568966B2

(12) United States Patent
Abbey et al.

(10) Patent No.: US 7,568,966 B2
(45) Date of Patent: Aug. 4, 2009

(54) GARMENT WITH BUILT IN CUSHION TO COMFORT SPINE

(75) Inventors: Philippa G. N. Abbey, Suwanee, GA (US); Justina Mazza Lyons, Alpharetta, GA (US)

(73) Assignee: Vanity Fair, Inc., Wilmington, DE (US)

( * ) Notice: Subject to any disclaimer, the term of this patent is extended or adjusted under 35 U.S.C. 154(b) by 296 days.

(21) Appl. No.: 10/936,759

(22) Filed: Sep. 9, 2004

(65) Prior Publication Data

US 2005/0101221 A1 May 12, 2005

Related U.S. Application Data

(60) Provisional application No. 60/501,406, filed on Sep. 10, 2003.

(51) Int. Cl.
*A41D 3/00* (2006.01)

(52) U.S. Cl. ..... 450/1; 450/57; 2/467; 2/44; 2/268

(58) Field of Classification Search ..... 450/1, 450/2, 57, 39, 54; 2/467, 44, 267, 268
See application file for complete search history.

(56) References Cited

U.S. PATENT DOCUMENTS

| | | | | |
|---|---|---|---|---|
| 2,477,792 | A | 8/1949 | Fratianni | |
| 3,135,961 | A | 6/1964 | Roderick | |
| 4,100,620 | A * | 7/1978 | Pecoraro | 2/461 |
| 4,143,654 | A | 3/1979 | Sherman | |
| 4,302,847 | A | 12/1981 | Miles | |
| 4,816,005 | A | 3/1989 | Braaten | |
| 4,870,706 | A * | 10/1989 | Ketcham et al. | 2/461 |
| 4,884,295 | A * | 12/1989 | Cox | 2/467 |
| 5,465,423 | A | 11/1995 | Taylor-Varney | |
| 5,709,648 | A | 1/1998 | Webb | |
| 5,765,224 | A | 6/1998 | Johnson | |
| 5,785,671 | A | 7/1998 | Striano | |
| 5,823,851 | A | 10/1998 | Dicker | |
| 5,855,561 | A | 1/1999 | Glidden | |
| 6,099,382 | A * | 8/2000 | Wilson | 450/89 |
| 6,110,005 | A * | 8/2000 | Stephenson et al. | 450/39 |
| 6,110,007 | A | 8/2000 | Rittmann | |
| 6,321,388 | B1 * | 11/2001 | Hildebrandt | 2/69 |
| 6,440,094 | B1 | 8/2002 | Maas | |
| 6,687,920 | B2 * | 2/2004 | Berns | 2/467 |
| 6,708,530 | B2 * | 3/2004 | Mitchell | 66/176 |
| 6,863,589 | B2 * | 3/2005 | Cano | 450/65 |
| 7,086,925 | B2 * | 8/2006 | Kaye et al. | 450/58 |

* cited by examiner

*Primary Examiner*—Gloria Hale
(74) *Attorney, Agent, or Firm*—Kenyon & Kenyon LLP

(57) ABSTRACT

The invention is directed to a garment, such as a tank top, camisole, bra top, shirt, athletic shorts or athletic pants, unitards or leotards, comprising a cushion for comforting the spine during activities performed while laying on the back, such as yoga, pilates, bodysculpting, exercising, etc. The garments of the present invention may further comprise a means for cushioning the clavicle, sternum, shoulder blades, hips or pelvis.

13 Claims, 4 Drawing Sheets

GARMENT WITH BUILT IN CUSHION TO COMFORT SPINE

CROSS-REFERENCE TO RELATED APPLICATIONS

This application claims the benefit under 35 U.S.C. 119(e) of U.S. Provisional Patent Application No. 60/501,406, filed Sep. 10, 2003.

FIELD OF THE INVENTION

The present invention relates to a garment, such as a tank top, camisole, bra top, shirt, athletic shorts or athletic pants, comprising a cushion for comforting the spine during activities performed while laying on the back, such as yoga, pilates, bodysculpting, exercising, etc.

BACKGROUND OF THE INVENTION

Activities that require lying on your back, or other bony protrusions such as your hips, shoulder blades, sternum, clavicle, or pelvis, can cause significant amounts of discomfort to the individual participating in such an activity. Until now, the only solution to this problem was to use a mat to lay on. However, mats may not always be available, and thus a means to comfort your spine (or other bony protrusion) without having to carry around a bulky mat, is needed. The present invention provides such a means, and can be used by an individual to participate in activities such as yoga, pilates, bodysculpting, exercising, etc., pain free.

SUMMARY OF THE INVENTION

It is a primary object of the present invention to provide a garment with built in cushioning to comfort the spine when the individual wearing the garment is laying on their back. Such garments include, but are not limited to, sports bras, sports shirts, sports pants, sports shorts, unitards and leotards.

It is a preferred object of the present invention to provide a sports bra comprising (i) at least one front panel; (ii) at least one back panel; and (iii) a cushioning system attached to the inner side of at least one back panel, and aligned such that when the sports bra is worn by an individual the cushioning system will follow the line of the spinal column. At least one front panel and at least one back panel are preferably each comprised of an outer layer and an inner lining.

It is a second preferred object of the present invention to provide a sports shirt comprising (i) at least one front panel; (ii) at least one back panel; and (iii) a cushioning system attached to the inner side of at least one back panel, and aligned such that when the shirt is worn by an individual it will follow the line of the spinal column, and further wherein at least one front panel and at least one back panel are made of a form fitting material.

It is a third preferred object of the present invention to provide a pant comprising (i) at least one front panel; (ii) at least one back panel; and (iii) a cushioning system attached to the inner side of at least one back panel, and aligned such that when the pant is worn by an individual it will follow the line of the spinal column.

DETAILED DESCRIPTION OF THE INVENTION

Figure 1:
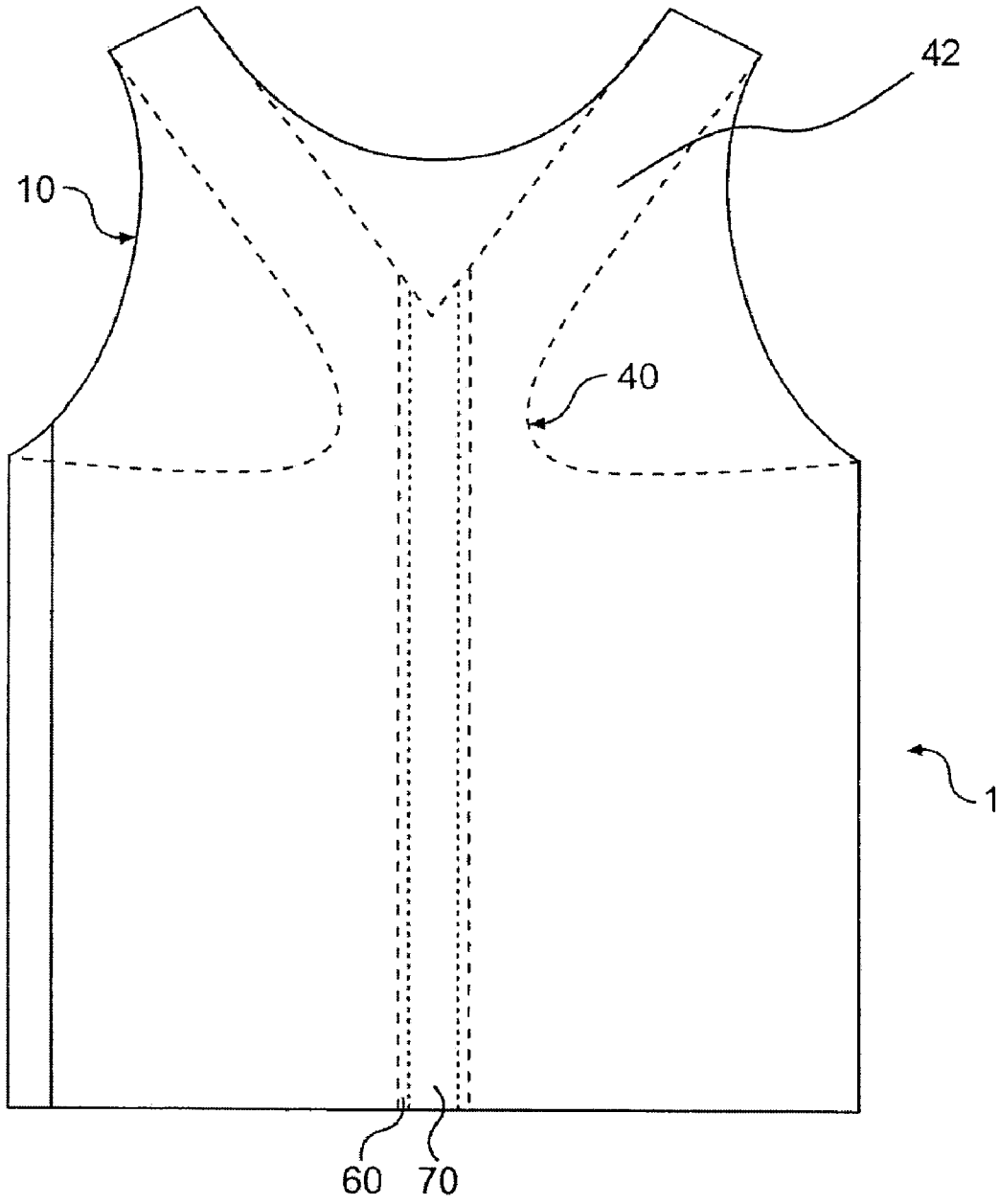
FIG. 1 is a perspective view of the sports bra of the present invention.
Figure 2A:
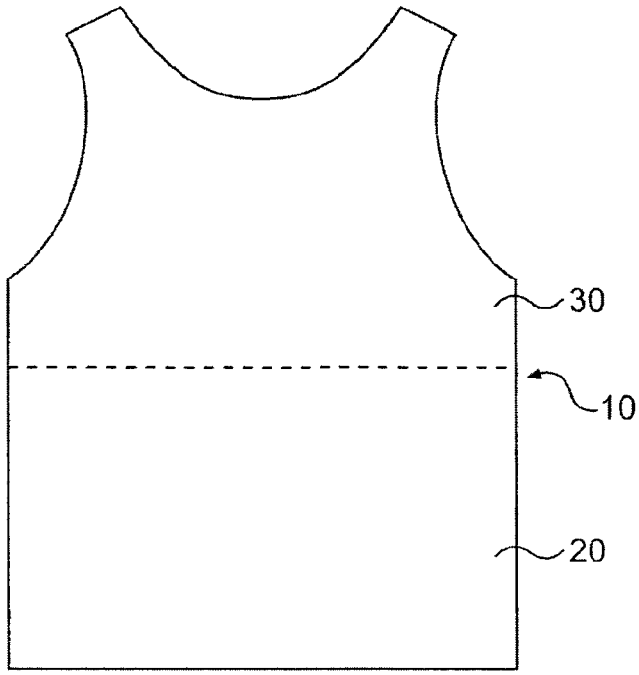
FIG. 2*a* is a perspective view of the front of a sports bra.
Figure 2B:
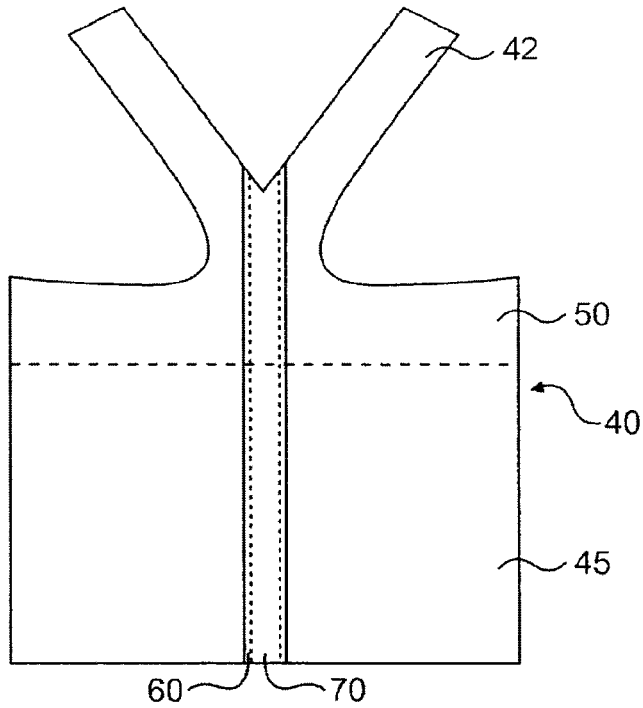
FIG. 2*b* is a perspective view of the inside of a back of a sports bra of the present invention with a cushioning system attached.
Figure 3A:
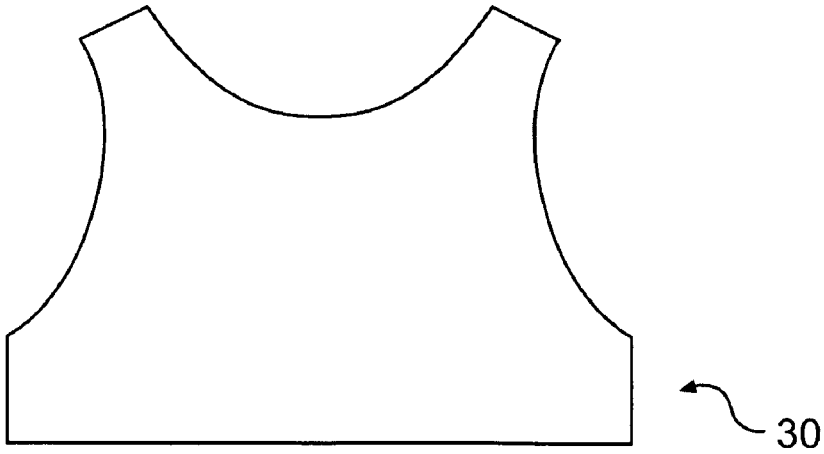
FIG. 3*a* is a perspective view of the inside lining for the front panel of the sports bra of the present invention.
Figure 3B:
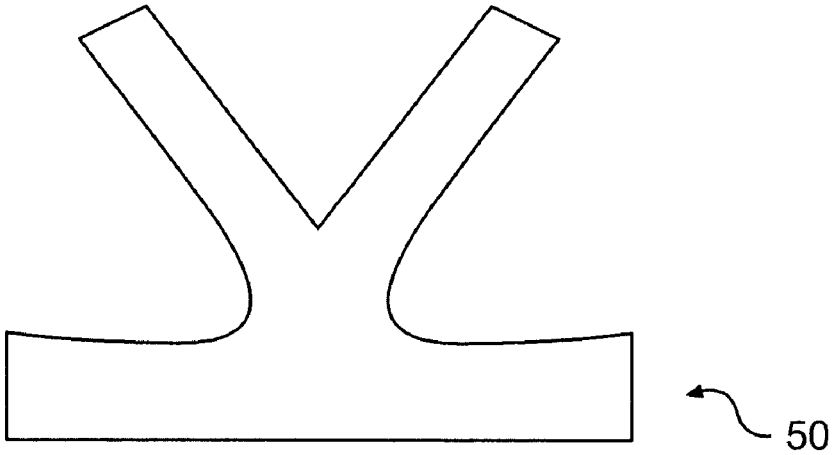
FIG. 3*b* is a perspective view of the inside lining for the back panel of the sports bra of the present invention.
Figure 4:
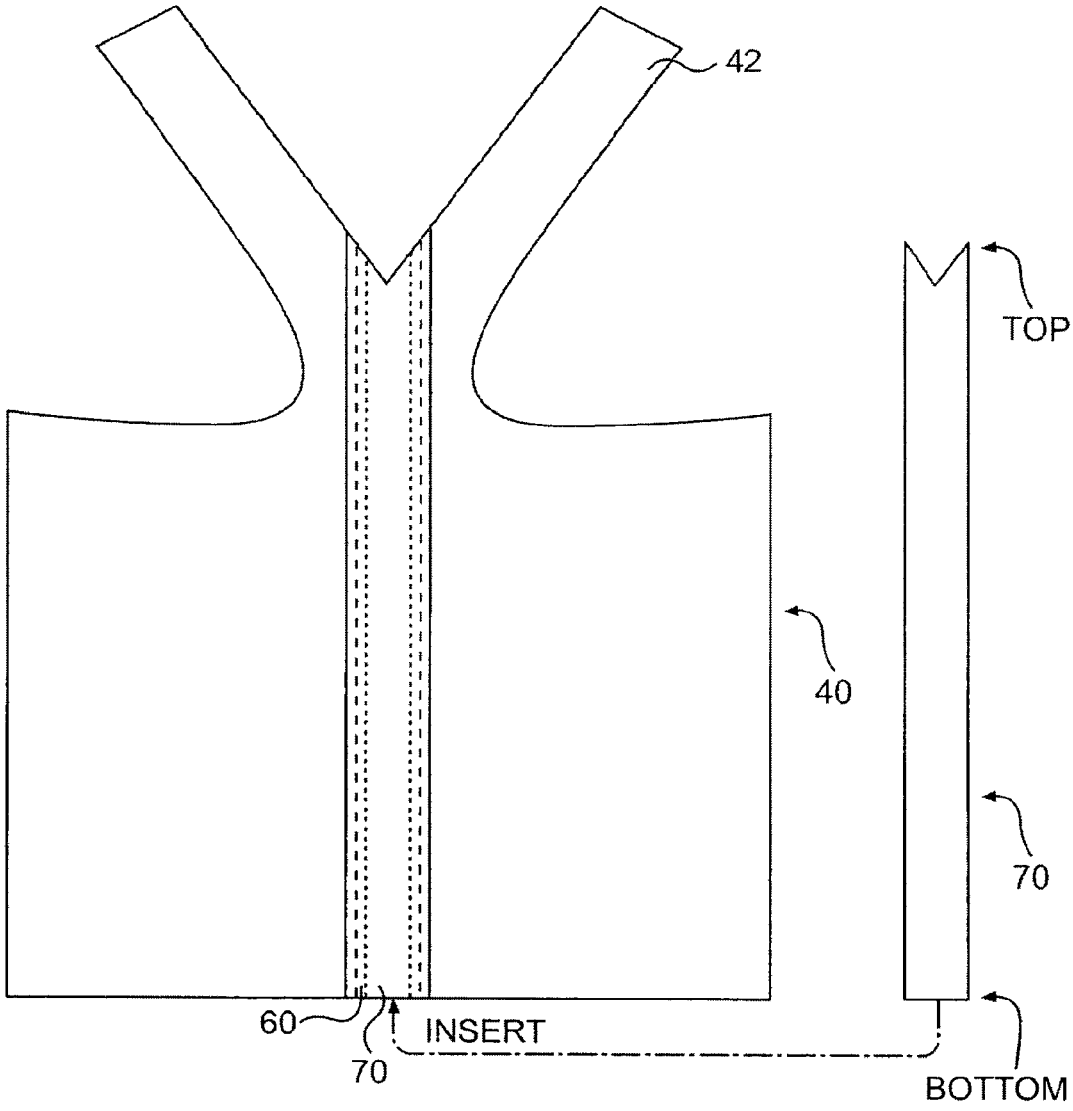
FIG. 4 is a perspective view of the inside of a back of a sports bra of the present invention, illustrating the insertion of the cushioning system.

Referring to FIG. 1, a perspective view of the sports bra, 1, made according to the present invention, is shown. It will be understood that the cushioning system of the present invention can be incorporated into any style of sports bra, athletic top, athletic short, athletic pant, unitard or leotard known to those of ordinary skill in the art. The sports bra, 1, features a front panel, 10, and a back panel, 40, with an attached cushioning system liner, 60, and a cushioning system 70, inserted within the cushioning system liner, 60. As shown in FIG. 2*a*, the front panel, 10, is preferably composed of an outer layer, 20, and an inner layer, 30 (see also FIG. 3*a*). Similarly, as shown in FIG. 2*b*, the back panel, 40, is preferably composed of an outer layer, 45, and an inner layer, 50 (see also FIG. 3*b*). Additionally, back panel 40 includes at least one support, such as strap 42 shown in FIGS. 1, 2*b*, and 4.

The cushioning system liner, 60, is preferably sewn onto the outer layer, 45, of the back panel, 40, leaving the bottom edge of the cushioning system liner, 60, free of stitches. Preferably after attachment of the cushioning system liner, 60, the cushioning system, 70, is inserted into the sleeve created when the cushioning system liner, 60, was attached to the outer layer, 45, of the back panel, 40 (see FIG. 4), and the unsewn edge of the cushioning system liner, 60, is sewn to hold the cushioning system, 70, in place. In an alternative embodiment, the cushioning system liner, 60, is sewn around the cushioning system, 70, like a cylinder, completely encompassing the cushioning system, 70, and subsequently the cushioning system liner, 60/cushioning system, 70, assembly is attached to the outer layer, 45, of the back panel, 40.

Attachment may be made by any means known to one of skill in the art, and include, but are not limited to, sewing, ultrasonic sealing, elastomeric bonding, heat bonding, etc. Furthermore, the cushioning system/cushioning system lining assembly may be attached by velcro to the back panel, 40.

After the cushioning system, 70, is inserted into the cushioning system liner, 60, and the cushioning system liner, 60, is sewn to close the opening, the inner layer, 50, of the back panel, 40, is attached to the outer layer, 45, preferably by sewing (see FIG. 2*b*). Similarly, the inner layer, 30, of the front panel, 10, is attached to the outer layer of the front panel, 20, by sewing.

The cushioning system, 70, is preferably composed of a variety of materials, including, but not limited to, particles, fluid, foam, and any combination of these materials. In a preferred embodiment, the cushioning system, 70, is composed of a spacer fabric, which is a knitted fabric consisting of two outer layers (front and back) with a yarn filler. The spacer fabric may be constructed with nylon, polyester, or a combination of both. Spacer fabrics are three dimensional fabrics that are encountered in many areas of technical textiles, but also in corsetry, underwear and sportswear, shoe fabrics, mattress fabrics, etc. Depending on the fabric construction, the upper face of the fabric can also be raised. The two outer layers of the fabric can have an open or tightly structured pattern.

In an alternative embodiment, the cushioning system, 70, is composed of a foam, such as OrthoLite®, memory foam, visco-elastic foam, or other foams known to one of skill in the art, such as polyurethane based foams. OrthoLite® is particularly advantageous because it enables air to travel through and around it (thus creating a cooler environment inside); it transports moisture away and disperses it evenly throughout the foam (thus promoting the quickest possible drying times), which results in a lack of moisture build-up and inhibits the growth of odor-causing bacteria; it is strong and maintains its integrity; it will not break down, abrade, or tear inside; it can have a biocide added, to fight against the presence of fungus, bacteria, and odor; it will not lose its shape when washed, and the biocide cannot be washed out; and it can be made in any thickness, hardness, and color needed.

In another alternative embodiment of the present invention, the cushioning system, 70, is composed of a fluid, such as a gel. In this embodiment, the preferred gel is a silicone gel, and the gel is located within a cylindrical pouch, or bladder, composed of an appropriate material such that the gel will not seep through, and such that the material will not be easily punctured.

The fabric used for the front and back panels, inner and outer layers, may be made of any natural or synthetic fabric suitable for use as a woman's sport top, such as cotton, polyester, circular or warp knits, nylon, linen, rayon, and blends thereof. Preferably, the inner and outer layers are anti-microbial, fabric technology that combines moisture transport, odor control and ease of cleaning all in one fabric. Also, there is a push/pull system (a system in which fabric wicks moisture away from the body) for the ultimate in confort. The fabric wicks moisture away from the wearer, allowing for a dryer, more comfortable feeling. In a preferred embodiment of the present invention, the outer layer is made of SUPPLEX® brand nylon and LYCRA® brand spandex, both available from E.I. du Pont de Nemours and Company. Of course, one of skill in the art will recognize that other materials may be used, such as cotton, polyester, and other acceptable fibers.

In an alternative embodiment of the present invention, the sports bra, 1, further comprises cushioning system(s) shaped and placed in such a way as to comfort the shoulder blades, sternum, and/or clavicle.

The sports bra of the present invention may further comprise a means of providing support for the breasts. Such breast support systems are disclosed, for example, in U.S. Pat. Nos. 6,116,985 and 6,165,045, and other breast support systems are well known to one of skill in the art, and include underwire and wireless support systems.

In another embodiment of the present invention, the cushioning system described above is incorporated in a non-bra sports shirt, which may be worn by men or women. The sports shirt would be constructed similar to the sports bra discussed above, in that it will have at least one front panel and one back panel, with the cushioning system located within a cushioning system liner attached to the center of the inside of the back panel, such that when the shirt is worn by an individual the cushioning system is aligned with the vertebrae. Furthermore, the front and back panels of the sports shirt may optionally be comprised of an outside layer and an inside layer. In addition, the sports shirt may have sleeves. The fabric used for the sport shirt would be similar to those used for the sports bra, discussed above, and would result in a form fitting, such that when the shirt is worn by the individual, the comforting system is held stably to the vertebrae (i.e., will not hang loosely from the body). The sports shirt may further comprise cushioning systems shaped and placed in such a way as to comfort the shoulder blades, sternum, and/or clavicle of the wearer.

In yet another embodiment of the present invention, the cushioning system described above is incorporated in a sport pant, such as a LYCRA® short or tight, comprising at least one front panel and at least one back panel. The cushioning system would be positioned such that it is aligned with and comforts the lower part of the spinal column, i.e. the sacrum and coccyx. In this embodiment, the sport pant may further comprise a cushioning system positioned such that it comforts the hips and/or pelvis.

In yet a further embodiment of the present invention, the cushioning system described above is incorporated in a unitard or leotard made out of a form fitting fabric, such as LYCRA®.

While the invention has been described and illustrated in connection with preferred embodiments, many variations and modifications evident to those skilled in this art may be made without departing from the spirit and scope of the invention, and the invention is thus not to be limited to the precise details of methodology or construction set forth above as such variations and modifications are intended to be included within the scope of the invention.

We claim:

1. A sports brassiere configured for use during exercise, comprising:

a means of providing support for the breasts; and a garment comprised of an elastomeric fiber, the garment further comprising:

at least one front panel;

a back panel having an outer layer including an inner side;

at least one support extending from a top edge of the back panel to a top edge of the at least one front panel; and a cushioning liner attached to the outer layer so as to form a sleeve for receiving a cushioning system, the cushioning system insertable within the sleeve such that it is aligned with and over the spinal column of the wearer, and the cushioning system being attached to the inner side of the back panel and extending along at least a portion of the at least one support.

2. The sports brassiere of claim 1, wherein said at least one front panel is comprised of an outer layer and an inner layer.

3. The sports brassiere of claim 1, wherein the back panel is comprised of the outer layer and an inner layer.

4. The sports brassiere of claim 3, wherein said inner layer is placed over the cushioning system, such that the cushioning system is sandwiched between said outer layer and said inner layer.

5. The sports brassiere of claim 1, wherein said cushioning system is comprised of a foam.

6. The sports brassiere of claim 5, wherein said foam is a polyurethane base foam.

7. The sports brassiere of claim 5, wherein said cushioning system further comprises a cushioning system lining.

8. The sports brassiere of claim 7, wherein said cushioning system lining completely surrounds said foam.

9. The sports brassiere of claim 7, wherein said cushioning system lining is a single piece of material wherein said foam is inserted between said cushioning system lining and said outer layer of said back panel.

10. The sports brassiere of claim 5, wherein said foam is memory foam, visco-elastic foam, or polyurethane based foam.

11. The sports brassiere of claim 1, wherein the at least one support is a pair of substantially V-shaped shoulder straps.

12. A sports brassiere configured for use during exercise, comprising:

a means of providing support for the breasts; and a garment comprised of an elastomeric fiber, the garment further comprising:

at least one front panel;

a back panel having an outer layer including an inner side;

at least one support for connecting the at least one front panel to the back panel, the at least one support extending from a top edge of the back panel to a top edge of the at least one front panel; and a cushioning liner attached to the outer layer so as to form a sleeve for receiving a cushioning system, the cushioning system insertable within the sleeve such that it is aligned with and over the spinal column of the wearer, and the cushioning system being attached to the inner side of the back panel and extending along at least a portion of the at least one support, and wherein the back panel is formed of a single piece of material.

13. The sports brassiere of claim 12, wherein the at least one support is a pair of substantially V-shaped shoulder straps.

* * * * *

UNITED STATES PATENT AND TRADEMARK OFFICE

CERTIFICATE OF CORRECTION

PATENT NO. : 7,568,966 B2
APPLICATION NO. : 10/936759
DATED : August 4, 2009
INVENTOR(S) : Abbey et al.

It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 525 days.

Signed and Sealed this

Seventh Day of September, 2010

David J. Kappos

David J. Kappos
*Director of the United States Patent and Trademark Office*